United States Patent [19]

Jacob et al.

[11] Patent Number: 4,786,401

[45] Date of Patent: Nov. 22, 1988

[54] LIQUID SLUDGE DISPOSAL PROCESS

[75] Inventors: Solomon M. Jacob, Cherry Hill; Grant G. Karsner, Voorhees Township; William J. Tracy, III, Sewell, all of N.J.

[73] Assignee: Mobil Oil Corporation, New York, N.Y.

[21] Appl. No.: 101,092

[22] Filed: Sep. 25, 1987

[51] Int. Cl.[4] ..... C10G 11/18; C10G 17/00; C10G 55/06

[52] U.S. Cl. ..... 208/85; 208/13; 208/113; 208/125; 208/180; 208/187; 585/240

[58] Field of Search ..... 208/13, 127, 113, 126, 208/85, 125, 180, 181, 187; 585/240

[56] References Cited

U.S. PATENT DOCUMENTS

| | | | |
|---|---|---|---|
| 2,922,758 | 1/1960 | Kostyreff | 208/187 |
| 3,146,185 | 8/1964 | Fella | 208/48 |
| 3,716,474 | 2/1973 | Hess et al. | 208/13 |
| 3,917,564 | 11/1975 | Meyers | 208/131 |
| 3,972,180 | 8/1976 | Van Gelder | 423/207 |
| 4,105,542 | 8/1978 | Fainman | 208/180 |
| 4,118,281 | 10/1978 | Yan | 201/25 |
| 4,308,411 | 12/1981 | Frankiewcz | 585/240 |
| 4,324,651 | 4/1982 | Rollmann et al. | 208/45 |
| 4,336,129 | 6/1982 | Yoshimura et al. | 208/180 |
| 4,409,091 | 10/1983 | Kessick | 208/187 |
| 4,417,976 | 11/1983 | Sander et al. | 208/13 |
| 4,552,649 | 11/1985 | Patterson | 208/127 |
| 4,666,585 | 5/1987 | Figgins | 208/131 |
| 4,686,048 | 8/1987 | Atherton et al. | 208/13 |

FOREIGN PATENT DOCUMENTS

| | | | |
|---|---|---|---|
| 0058705 | 5/1979 | Japan | 208/180 |

*Primary Examiner*—Anthony McFarlane

*Attorney, Agent, or Firm*—Alexander J. McKillop; Michael G. Gilman; Malcolm D. Keen

[57] ABSTRACT

Hydrocarbon-containing liquid waste sludges from refinery waste streams can be disposed of by blending with the feedstock being passed to a fluid catalytic cracking unit. Preferably, the sludge is premixed with a hydrocarbon, such as a light oil, prior to mixing with the feed.

3 Claims, 1 Drawing Sheet

LIQUID SLUDGE DISPOSAL PROCESS

BACKGROUND OF THE INVENTION

1. Field of the Invention

This invention relates to a process for the disposal of oil and water containing waste streams, such as hydrocarbon-containing liquid sludges from a petroleum refinery.

2. Description of the Prior Art

Liquid sludges from petroleum refineries have been disposed of by incineration, an unsatisfactory and energy wasteful procedure. A more satisfactory procedure involves disposing of the sludge via a coking process. Coking, as is well known, is used to obtain hydrocarbons of higher value from heavy oil residues, such as the residues remaining after a crude oil has been distilled. If sludge disposal is properly incorporated into a coking process, additional hydrocarbon values can be obtained without adversely effecting the coking process or the quality of the coke produced.

Coking facilities are not always available, and even if they were, there exists a need to provide an alternate and even more convenient route for the disposal of hydrocarbon-containing sludges.

SUMMARY OF THE INVENTION

The present invention is a practical, energy-conserving and economically desirable process for disposing of hydrocarbon-containing liquid sludges. More specifically, the present invention is a process for the disposal of a hydrocarbon-containing liquid waste sludge, which comprises mixing the sludge with the hydrocarbon feedstock to a fluid catalytic cracking reactor. In a preferred embodiment, the waste sludge is mixed with a light oil petroleum fraction fraction prior to being mixed with the feedstock.

DETAILED DESCRIPTION OF THE INVENTION

Figure 1:
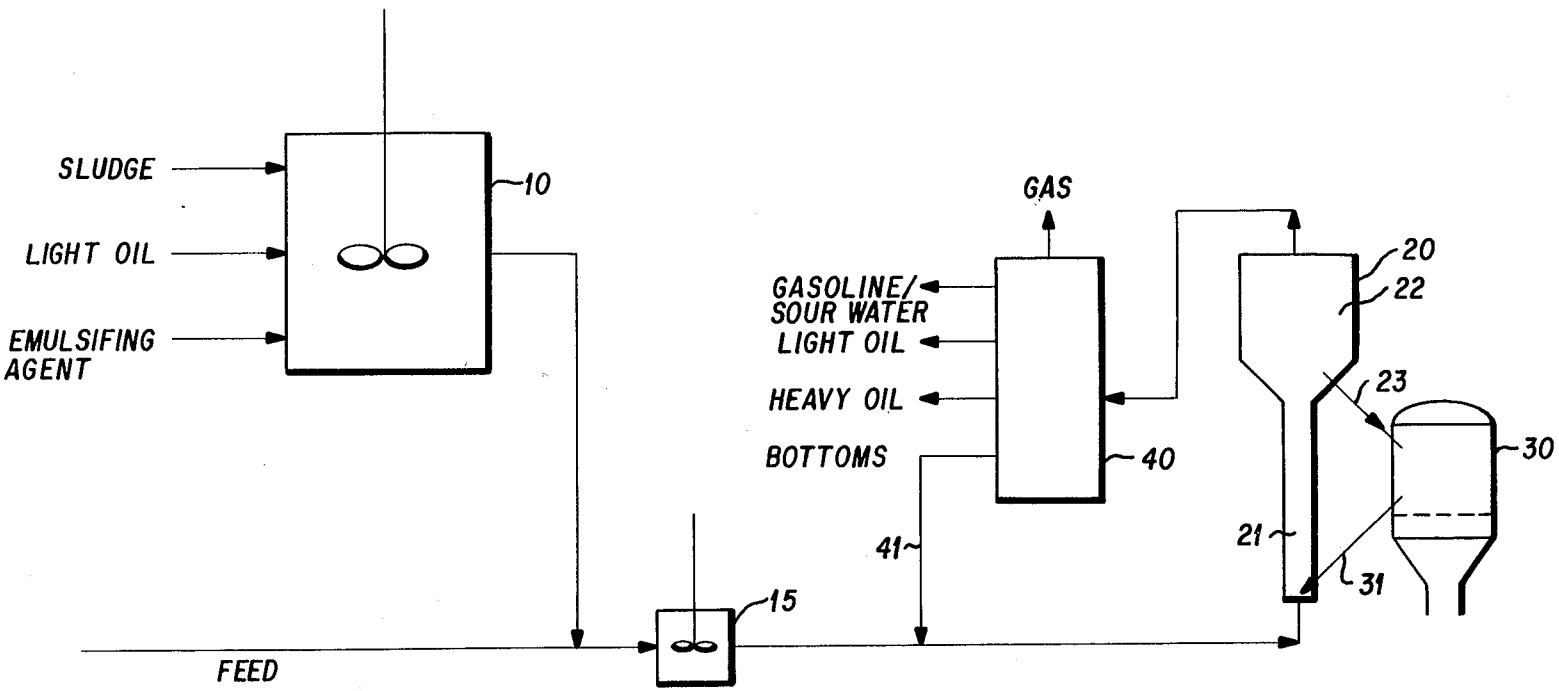
FIG. 1 is a schematic flow diagram illustrating a preferred embodiment of the present invention.

Hydrocarbon-containing liquid sludges generally are refinery waste streams in the form of an oil-in-water emulsion. Refinery waste streams are a composite of many waste streams, such as limited vacuum tower emulsions, desalter emulsions, coker system blow down, dewaxing reactivation liquids, alkylation unit tar, API separator skimmings, slop oil emulsions, and the like. A typical composite refinery waste stream contains about 10–22% by weight of hydrocarbons, about 75–85% of water and about 3% by weight of solids. It is the solids, mainly dirt, rust and carbonaceous by-products, in finely divided form, which act as emulsion stabilizers and cause the waste stream to form a sludge.

Sludges, which contain a large amount of water, may be partially dewatered by conventional means prior to mixing or blending with the feed being passed to the fluid catalytic cracking reactor. Viscous sludges, particularly dewatered sludges, may be preheated to make them more fluid and more readily miscible with the hydrocarbon feedstock.

In a preferred embodiment of the invention, the sludge, optionally dewatered, is premixed with a liquid hydrocarbon to render it more miscible with the feedstock being passed to the fluid catalytic cracking reactor. Light oils that would be cracked in the reactor to a gasoline range product are particularly suitable for this purpose. Mixing the hydrocarbon-containing liquid sludge with sufficient additional liquid hydrocarbon causes inversion to occur and converts the oil-in-water emulsion of the sludge to a water-in-oil emulsion. One skilled in the art could readily determine when phase inversion has occurred. Water-in-oil emulsions more readily mix or blend with the hydrocarbon feedstock because emulsions generally exhibit characteristics of the external phase. In addition, providing the liquid sludge as a water-in-oil emulsion eliminates the risk of feeding slugs of water to the cracking reactor, improves the dispersion of solid particles which may otherwise precipitate in the equipment, and enhances mixing in the FCC riser zone by vaporization of an internal water phase.

Emulsifying agents such as non-ionic surfactants having a low hydrophile-lipophile balance (HLB) may be added to promote formation of the water-in-oil emulsion. Suitable emulsifying agents for this purpose are listed in the Kirk-Othmer "Encyclopedia of Chemical Technology", Vol. 8, pages 910–917, 3rd Edition, John Wiley & Sons (1979).

The fluid catalytic cracking units that may be utilized to dispose of hydrocarbon-containing liquid waste sludges according to the process of the present invention are of the conventional type currently in use. The construction and operation of fluid catalytic cracking units is well known to those skilled in the art. The basic operation of such a unit is illustrated in FIG. 1. A typical unit comprises three main sections, the reactor proper 20, a catalyst regenerator 30 and a fractionator 40 for separating the hydrocarbon product from the reactor into various fractions. The reactor 20 comprises a riser 21 wherein the feedstock and regenerated catalyst entering via line 31 are contacted, and an upper bulbous portion 22 wherein the cracked feedstock is separated from the catalyst. The catalyst is passed via line 23 to the regenerator 30 for regeneration, and the cracked product is fractionated in fractionator 40 in a conventional manner to separate gas, gasoline, light oil and heavy oils from the bottoms. The gasoline fraction would contain additional sour water, originating from the sludge, which would be separated in the normal manner. All or a portion of the heavier fractions may be recycled to the reactor, but only recycle of the bottom via line 41 is illustrated.

According to a preferred embodiment of the invention, the hydrocarbon-containing waste sludge to be disposed of is mixed with a light hydrocarbon oil in zone 10, preferably a light oil from the fractionator that is being recycled to the reactor. Before being passed to the bottom of riser 21, the sludge and light oil mixture may be further mixed in an in line mixer 15. The fresh feedstock containing waste sludge, preferably mixed with light oil, is then mixed or blended with the material from the fractionator 40 being recycled to reactor 20.

The fresh feedstock containing waste sludge, preferably premixed with light oil, and mixed with material being recycled from the fractionator, is passed to the bottom of riser 21. At that point the hydrocarbons and water present contact hot regenerated catalyst from the regenerator and are vaporized. The vaporized water and the steam (not shown) added to the bulbous portion 22 of the reactor to strip hydrocarbon products from the catalyst are subsequently separated from the hydrocarbon products in the usual manner. The finely divided solids initially contained in the liquid sludge pass up riser 21 together with the catalyst and then via line 23 to regenerator 30 where the carbonaceous materials present are oxidized. The periodic addition of makeup catalyst to the regenerator avoids build-up of uncombusted inorganic solids originating from inorganic values present in both the feedstock and in the waste sludge.

To minimize the risk of poisoning the catalyst and to keep the rate of addition of makeup sludge close to that customarily employed, the waste sludge content of the feed being fed to the reactor should be kept relatively small. The amount of sludge to be added will depend primarily on its composition and can be readily determined by monitoring operation of the fluid catalytic cracking unit. Typically, the feedstock being passed to the fluid catalytic cracking reactor will contain about 2 parts by volume of sludge premixed with about 10 parts by volume of light oil per 1000 parts of feedstock.

In an alternate embodiment, a separate, small-scale catalytic cracking unit may be provided or constructed specifically intended and adapted to handle refractory sludges, slop oils, and the like. That unit would utilize spent or nearly spent catalyst from a primary cracking unit. Using this embodiment, greater quantities of waste sludge could be processed while at the same time preserving catalyst activity in the primary cracking units. Thus, the small-scale cracking unit could serve as a substitute or even eliminate the need for the incinerator or other means used to dispose of waste sludges in the refinery.

What is claimed is:

1. A process for the disposal of a hydrocarbon-containing petroleum refinery liquid sludge waste stream in the form of an oil-in-water emulsion, which comprises mixing the sludge with a hydrocarbon oil to cause the oil-in-water emulsion to invert to a water-in-oil emulsion and mixing the water-in-oil emulsion with a feedstock for a fluid catalytic cracking reactor, and feeding the water-in-oil emulsion and the feedstock to the fluid catalytic cracking reactor in which the oil and the feedstock are subjected to catalytic cracking.

2. A process according to claim 1, wherein the liquid waste sludge is partially dewatered prior to mixing with the feedstock.

3. A process according to claim 1, wherein the mixing of the sludge with the hydrocarbon oil is effected in the presence of an emulsifying agent.

* * * * *